United States Patent [19]

Weiss

[11] Patent Number: 4,982,943

[45] Date of Patent: Jan. 8, 1991

[54] ARRANGEMENT FOR PRESSING A PAPER STACK AGAINST SEPARATING ROLLERS

[75] Inventor: Udo Weiss, Siegen, Fed. Rep. of Germany

[73] Assignee: U.S. Philips Corporation, New York, N.Y.

[21] Appl. No.: 314,015

[22] Filed: Feb. 22, 1989

[30] Foreign Application Priority Data

Feb. 25, 1988 [DE] Fed. Rep. of Germany ..... 3805822

[51] Int. Cl.[5] ..... B65H 1/26

[52] U.S. Cl. ..... 271/157; 271/160; 271/171; 221/198

[58] Field of Search ..... 271/157, 160, 162, 171, 271/164, 126, 127, 147, 22, 24, 30.1, 128; 221/198, 279, 227, 231, 60, 59, 57

[56] References Cited

U.S. PATENT DOCUMENTS

| | | | |
|---|---|---|---|
| 3,977,666 | 8/1976 | Suzuki et al. | 271/171 X |
| 4,089,402 | 5/1978 | Hyland et al. | 400/625 |
| 4,219,192 | 8/1980 | Burke | 271/160 |
| 4,726,698 | 2/1988 | Weiss et al. | 400/629 |

FOREIGN PATENT DOCUMENTS

| | | | |
|---|---|---|---|
| 40156 | 3/1980 | Japan | 271/127 |
| 145041 | 11/1981 | Japan | 271/160 |
| 4835 | 1/1982 | Japan | 271/171 |
| 16948 | 1/1987 | Japan | 271/160 |

*Primary Examiner*—David H. Bollinger
*Attorney, Agent, or Firm*—William Squire

[57] ABSTRACT

A paper sheet cassette includes a rotatable guide shaft and a leaf spring secured at one end to the shaft. A pressure plate secured to the shaft receives a stack of paper sheets and is resiliently urged against a feed roll by the spring. The spring and pressure plate are settable to different angular positions to adjust the pressure of the stack against the feed roll and to permit the stack to be placed on the plate.

12 Claims, 3 Drawing Sheets

Figure 1:
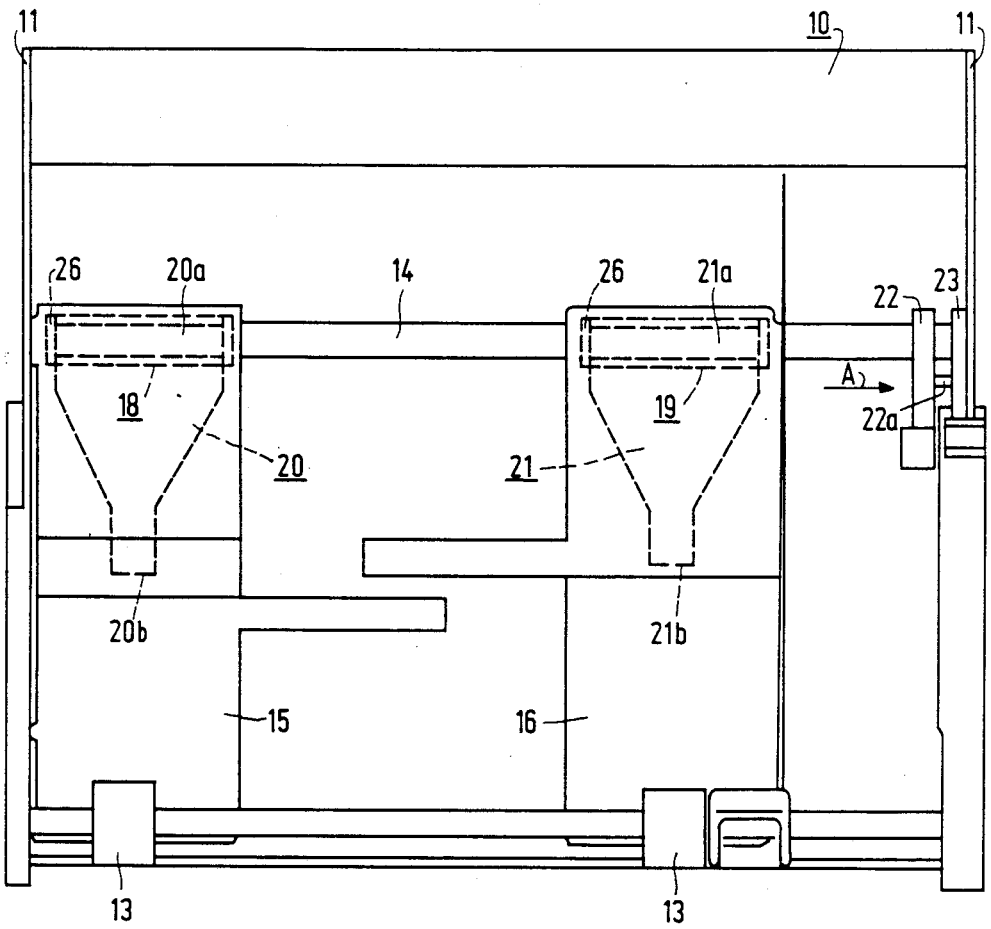

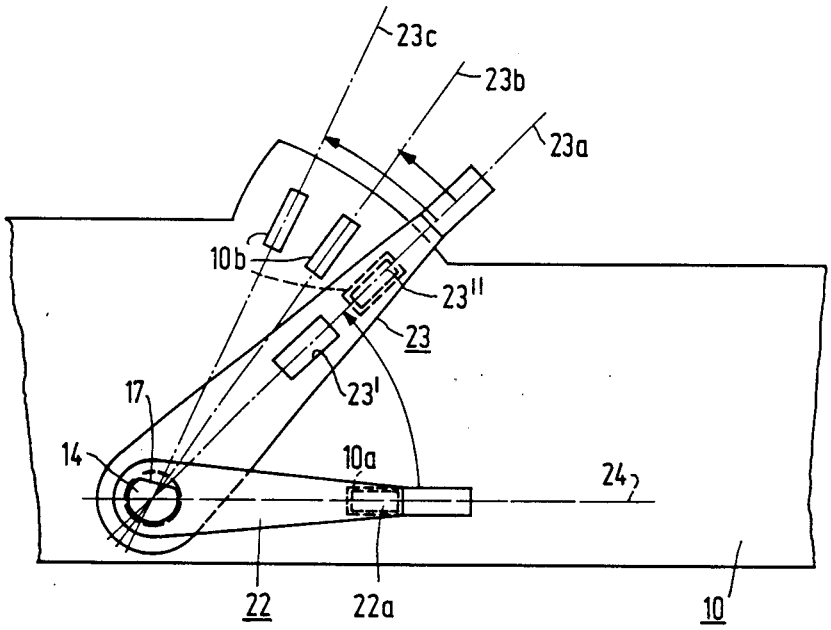
FIG.3
FIG.4a
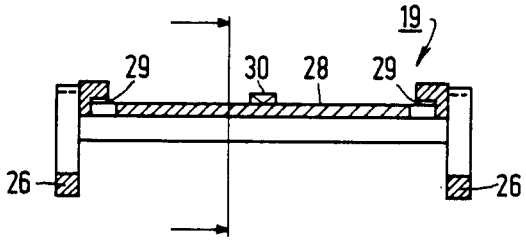
FIG.4c
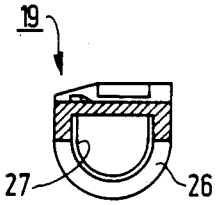
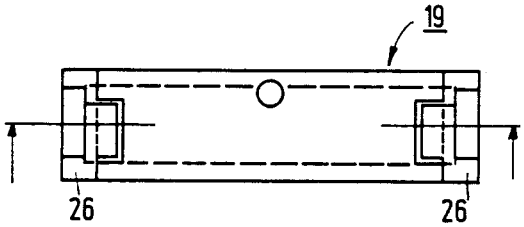
FIG.4b

ARRANGEMENT FOR PRESSING A PAPER STACK AGAINST SEPARATING ROLLERS

The invention relates to an arrangement for pressing a paper-sheet stack resting in a cassette on a pressure plate against separating rollers mounted at the end and intended for a single-sheet draw-off, with a guide shaft which is mounted at the start of the cassette and on which the pressure plate under spring pressure is mounted pivotably on one side, with an adjustable pressing force.

An arrangement of this type is known, for example, from German Offenlegungsschrift No. 3,427,514, corresponding to U.S. Pat. No. 4,726,698 and assigned to the Assignee of the present invention. In the known arrangement, the compression spring generating the pressing force is attached to a separate slide which itself is supported on a carrier plate mounted on the guide shaft. The pressing force is adjusted by means of different locking positions of the spring within the slide.

The present object on which the invention is based is to simplify an arrangement of the type mentioned in the introduction in terms of the adjustability of the pressing force. According to the invention, this object is achieved because one end of a blade spring is coupled fixedly in terms of relative rotation to the rotatably mounted guide shaft, whilst the other end of the blade spring rests directly against the pressure plate, and because the guide shaft is arranged so as to be lockable in different rotary positions. The arrangement according to the invention does away with the need for a special carrier plate for retaining the blade spring. The blade spring is attached by simple means to the guide shaft provided in any case for the pressure plate. According to the invention, the adjustability of the pressing force is obtained in a simple way as a result of the rotation of the lockably arranged guide shaft.

In an advantageous embodiment of the invention, the first end of the blade spring is mounted in a moulding connected positively to the guide shaft. This allows a simple assembly of the blade spring with a rotatable guide shaft. In a further embodiment of the invention, a simple rotationally fixed coupling between the blade spring on the one hand and the guide shaft on the other hand is obtained because the guide shaft is flattened, that is to say has a D-shaped cross-section, and because the inner bore of the moulding is matched to this cross-sectional profile of the guide shaft. A positive coupling between the guide shaft and the moulding and therefore the end of the blade spring connected to the moulding is thereby obtained in a simple way. Furthermore, the moulding can be displaced slidably in the longitudinal direction of the guide shaft. In an expedient embodiment, the moulding has two lateral webs with D-shaped orifices matched to the form of the guide shaft, and fastening means for retaining the first end of the blade spring. Retention appropriately occurs because between the webs there is a support with lateral grooves and with at least one locking projection, the blade-spring end received by the grooves having at least one locking orifice for the engagement of the locking projection. This guarantees, on the one hand, a secure positive connection and, on the other hand, a firm retention of the end of the blade spring on the moulding. The blade spring held in the moulding by means of one of its ends slides with its free end on the underside of the pressure plate, so that, during rotation of the guide shaft, a reliable transmission of force to the pressure plate is guaranteed, without the danger of jamming. The arcuate shape according to a further advantageous embodiment of the invention guarantees a sufficient pressing force at all times.

A guide shaft is actuated in a simple way preferably via a lever located in the lateral region of the cassette and connected fixedly in terms of relative rotation to the guide shaft. At the same time, in the swung-down state, this lever can preferably be locked on the cassette in a first position. The lever serves for swinging down the pressure plates in order to make it possible to insert the paper. During the operation of swinging the paper up against the separating rollers by means of the lever, the end position of the latter determines the amount of pressing force. For this purpose, in the swung-up state, the lever can preferably be locked in several positions, the lever engaging into a rotary part which is itself arranged so that it can be fixed on the cassette in several positions.

Preferably, a cassette has two pressure plates which are mounted rotatably on the same guide shaft and which, during the actuation of the guide shaft, can be actuated simultaneously and in the same direction. These pressure plates can be arranged in such a way that either both are mounted so as to be displaceable or non-displaceable in the longitudinal direction of the guide shaft or only one of the two pressure plates is longitudinally displaceable, whilst the other is arranged non-displaceably, for example on one side edge of the cassette. Allowance can therefore be made in a simple way for different paper sizes.

The simple arrangement according to the invention for adjusting the pressing forces between the paper and separating rollers makes it possible to process different types of paper and paper weights in a reliable way. With a cassette having two pressure plates for processing different paper sizes, the pressing forces can be varied by means of a single lever acting on the two pressure plates, and the pressure plates can be arranged displaceably or lockably in the direction of the guide shaft.

An exemplary embodiment of the invention is illustrated in FIGS. 1 to 4 of the drawing and described together with further advantages in the description of the drawing.

Figure 2:
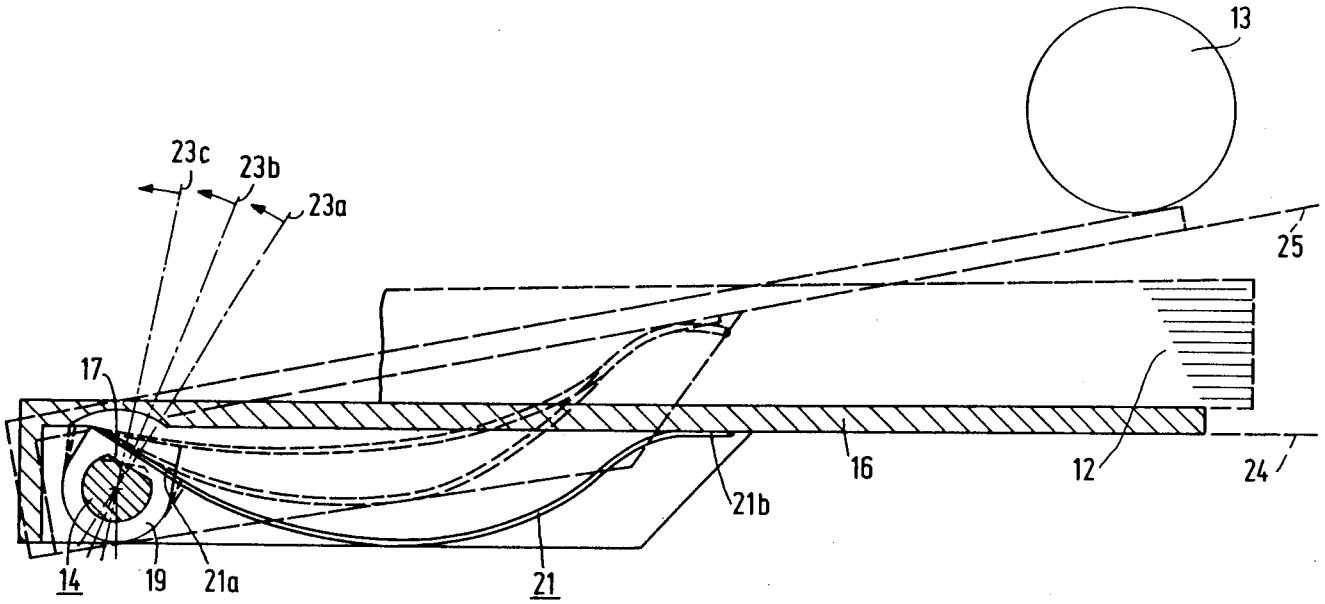

FIG. 1 shows diagrammatically a top view of a cassette with two pressure plates according to the invention, FIG. 2 shows diagrammatically a side view according to FIG. 1, partially in section, with the non-essential parts omitted, FIG. 3 shows an elevation view, partially in section, of the embodiment of FIG. 1; and FIGS. 4*a*, 4*b* and 4*c* show further views of the arrangement according to the invention.

FIG. 1 shows a cassette 10 with side walls 11 for receiving a paper stack 12 (FIG. 2). Arranged at the end of the cassette 10 are separating rollers 13 which are part of a device for drawing off single sheets. The separating rollers 13 are driven by means of a drive (not shown). Located at the start of the cassette 10 is a guide shaft 14 which is mounted rotatably in the side walls 11 and on which two pressure plates 15, 16 are arranged rotatably mounted. The guide shaft 14 has a flattened portion 17 (FIG. 2) and carries two mouldings 18, 19 for receiving two blade springs 20, 21 at their ends 20*a*, 21*a*. The inner bores of the mouldings 18, 19 rest positively on the flattened guide shaft 14. The free ends 20*b*, 21*b* rest freely against the underside of the pressure plates 15, 16.

The guide shaft 14 is actuated by means of a laterally mounted lever 22 which is connected firmly to the guide shaft 14 and which is adjustable from outside. The lever 22 is used for swinging down the pressure plates 15, 16 in order to make it possible to insert the paper stack 12 on plates 15, 16. During the operation of swinging up the plates 15, 16 and thus the paper stack 12 by means of the lever 22, the upper end position of the plates determines the amount of the pressing force. To allow simple operation, the lever 22 engages an additional rotary part 23 which can be fixed on the cassette, for example, in three positions 23*a*, 23*b*, 23*c* (FIG. 3). A separation between the paper insertion position of plates 15, 16 and the pressing force applying position of plates 15, 16 is thereby achieved.

FIG. 2 shows the pressure plate 16 in two different positions, specifically in the swung-down stack insertion position 24 and in the swung-up pressure applying position 25. In the swung-up position 25, the lever 22 is locked in the position 23*a* of the rotary part 23. Further positions of the rotary part 23 which the engaged lever 22 can thus also assume are denoted by 23*b* and 23*c*. The pressing force is thereby increased. Consequently, the pressing force exerted on the paper stack 12 resting on the pressure plate 16 can be varied simply and effectively by relocating the position of part 23, thus guaranteeing a reliable single-sheet draw-off by the separating rollers 13.

FIG. 3 shows a sectional view in the direction A FIG. 1. The lever 22 engages by means of a boss 22*a* either into a locking orifice 10*a* of the cassette (position 24) or, after rotation, into locking orifice 23' of the rotary part 23 (positions 25/23*a*, 23*b*, 23*c*). The rotary part 23 is mounted rotatably on the guide shaft 14 and has a locking projection 23" for engagement into locking orifices 10*b* of the cassette 10.

FIGS. 4*a*, 4*b* and 4*c* three different views, partially in section, of a plastic guide part 19 comprising lateral webs 26, the D-shaped orifices of which are matched to the cross-sectional profile of the guide shaft 14. Numeral 28 designates a support for the end 21*a* of a blade spring 21 which is held by means of lateral clamping grooves 29. Numeral 30 denotes a stud which engages into a corresponding locking orifice in the blade spring 21, thus guaranteeing a reliable retention of the blade spring 21 in the guide part 19.

What is claimed is:

1. Arrangement for pressing a paper sheet stack resting in a cassette on at least one pressure plate against at least one sheet feed roller mounted adjacent to an end of the cassette, said roller for drawing off one sheet at a time from the stack, said arrangement including a guide shaft pivotably secured to the cassette for rotation about an axis, said shaft being secured to the cassette at a region of the cassette distal said end and said at least one pressure plate pivotably secured to the cassette at one plate end for rotation relative to the cassette, the combination therewith comprising:

a leaf spring having first and second ends, the first end being secured to the guide shaft for rotation with the shaft, the second end of the spring resting resiliently against the pressure plate; and means for releasably securing said guide shaft and said pressure plate at a plurality of angular positions about said axis.

2. Arrangement according to claim 1, characterized in that the arrangement includes a molding secured to said shaft, the first end of the spring being fastened to the molding.

3. Arrangement according to claim 2, characterized in that the guide shaft has a flattened portion forming a profile, said molding having a bore matched to the profile of the guide shaft.

4. Arrangement according to claim 3, characterized in that the molding has end faces and webs located on the end faces and said bore and profile are D-shaped, and fastening means for retaining the first end of the spring.

5. Arrangement according to claim 4, characterized in that said fastening means includes a support with spring receiving lateral grooves and at least one spring locking projection for receiving the spring thereto, said support being positioned between the webs, said spring having at least one locking orifice for engagement with the locking projection.

6. Arrangement according to claim 5, characterized in that the spring is dimensioned to rest slidably with its second end against a side of the pressure plate.

7. Arrangement according to claim 1, characterized in that, the spring has an arcuate shape.

8. Arrangement according to claim 1, characterized in that the means for releasably securing includes a lever secured to the guide shaft, one of said positions placing the plate in a stack insertion state.

9. Arrangement according to claim 8, characterized in that means are included for locking the lever to the cassette in said one position.

10. Arrangement according to claim 8, characterized in that the lever has a stack pressure applying state in a second of said positions, said means for securing including means for securing the lever in said angular positions, and further including a rotary part, the lever engaging into the rotary part which part is itself arranged so that it can be releasably fixed to the cassette in said angular positions.

11. Arrangement according to claim 1, characterized in that the cassette includes two pressure plates which are mounted rotatably on said guide shaft and which, during the releasably securing of the guide shaft, are simultaneously placed in said angular positions in the same direction.

12. Arrangement according to claim 11, characterized in that plate displacement means are included wherein at least one of the pressure plates is longitudinally displaceable on the shaft along the axis.

* * * * *